US010758961B2

(12) United States Patent
Serbes

(10) Patent No.: US 10,758,961 B2
(45) Date of Patent: Sep. 1, 2020

(54) MECHANICAL SPREADER

(71) Applicant: CARROSSERIE TECHNIC, Cuesmes (BE)

(72) Inventor: Haydar Serbes, Binche (BE)

(73) Assignee: CARROSSERIE TECHNIC, Cuesmes (BE)

( * ) Notice: Subject to any disclaimer, the term of this patent is extended or adjusted under 35 U.S.C. 154(b) by 246 days.

(21) Appl. No.: 16/061,753

(22) PCT Filed: Dec. 20, 2016

(86) PCT No.: PCT/EP2016/081842
§ 371 (c)(1),
(2) Date: Jun. 13, 2018

(87) PCT Pub. No.: WO2017/108739
PCT Pub. Date: Jun. 29, 2017

(65) Prior Publication Data

US 2018/0361449 A1 Dec. 20, 2018

(30) Foreign Application Priority Data

Dec. 22, 2015 (EP) ..... 15201996

(51) Int. Cl.
*B21D 41/02* (2006.01)
*B21D 39/20* (2006.01)
(Continued)

(52) U.S. Cl.
CPC ..... *B21D 41/028* (2013.01); *B21D 39/08* (2013.01); *B21D 39/20* (2013.01); *B21D 41/02* (2013.01);
(Continued)

(58) Field of Classification Search
CPC ..... B21D 39/20; B21D 39/08; B21D 41/02; B21D 41/021; B21D 41/026; B21D 41/028; B21D 3/00; B21D 1/08; B21D 1/12
See application file for complete search history.

(56) References Cited

U.S. PATENT DOCUMENTS 2,447,401 A 8/1948 Ferguson et al.
2,606,469 A 8/1952 Morgenthaler
(Continued)

FOREIGN PATENT DOCUMENTS

CN 102275154 12/2011
JP 2007319919 A * 12/2007 ..... B21D 39/20

*Primary Examiner* — Pradeep C Battula
(74) *Attorney, Agent, or Firm* — Duane Morris LLP; Gregory M. Lefkowitz

(57) ABSTRACT

A mechanical spreader along a spreading axis, characterized in that it comprises a support (1) and two spreading plates (2), each spreading plate (2) comprising at least one bevel (3), and in that it also comprises a central rod (4) able to slide in said support (1) between the two spreading plates (2), said central rod (4) comprising a plurality of bevels (5) having a profile complementary to the bevels (3) of said spreading plates (2), the bevels (5) of said central rod (4) being in contact with the bevels (3) of said spreading plates (2), said spreader also comprising return means able to exert a return force on the spreading plates (2), means for pushing the central rod (4) and means for immobilizing the spreading plates (2) in planes perpendicular to said spreading axis.

7 Claims, 3 Drawing Sheets

(51) Int. Cl.

| | |
|---|---|
| ***B21D 39/08*** | (2006.01) |
| *B21D 3/00* | (2006.01) |
| *B21D 1/12* | (2006.01) |

(52) U.S. Cl.
CPC ..... *B21D 41/026* (2013.01); *B21D 1/12* (2013.01); *B21D 3/00* (2013.01); *B21D 41/021* (2013.01)

(56) References Cited

U.S. PATENT DOCUMENTS

| | | | | |
|---|---|---|---|---|
| 2,687,763 | A | 8/1954 | Perkins | |
| 2,919,741 | A * | 1/1960 | Strock | B21D 41/02 72/305 |
| 3,635,440 | A | 1/1972 | Van Gompel | |
| 4,308,736 | A * | 1/1982 | Lowe | B21D 41/02 72/31.06 |
| 8,511,133 | B1 | 8/2013 | Chen | |
| 9,248,617 | B2 * | 2/2016 | Lundequist | B21D 39/20 |
| 2006/0201228 | A1 * | 9/2006 | Rothenberger | B21D 41/021 72/393 |

* cited by examiner

MECHANICAL SPREADER

CROSS-REFERENCE TO RELATED APPLICATIONS

This application is a § 371 national stage entry of International Application No. PCT/EP2016/081842, filed Dec. 20, 2016, which claims priority to European Application No. 15201996.4, filed Dec. 22, 2015, the entire contents of which are incorporated herein by reference.

FIELD OF THE INVENTION

The invention relates to the technical field of mechanical spreaders, in particular used to straighten the chassis of a vehicle.

The invention more particularly relates to a hydraulic spreader for straightening a longeron of the chassis of a vehicle.

BACKGROUND OF THE INVENTION

Document CN102275154 discloses a hydraulic spreader comprising separating arms actuated by a hydraulic piston. This type of spreader can be used in bodywork, in particular to straighten the longerons of the chassis of a vehicle that are curved due to an accident. Once the longerons are straightened using a straightening bracket, a crease is typically observed at the initial curve. It is then necessary to insert a spacing tool inside the longeron, which is generally a beam with a hollow section. It has, however, been able to be observed that the device disclosed in the prior art document was difficult to use and did not offer optimal performance to cause the creases observed in the longerons to disappear.

BRIEF DESCRIPTION OF THE INVENTION

One aim of the invention is to resolve the aforementioned drawbacks of the prior art.

The aim of the present application is therefore to propose a spreader that is easy to use and effective in body straightening work, in particular to cause the disappearance of the creases observed in the longerons of the chassis of a vehicle.

To that end, the invention relates to a mechanical spreader along a spreading axis, characterized in that it comprises a support and two spreading plates, each spreading plate comprising at least one bevel, and in that it also comprises a central rod able to slide in said support between the two spreading plates, said central rod comprising a plurality of bevels having a profile complementary to the bevels of said spreading plates, the bevels of said central rod being in contact with the bevels of said spreading plates, said spreader also comprising return means able to exert a return force on the spreading plates, means for actuating the translation of the central rod and means for immobilizing the spreading plates in planes perpendicular to said spreading axis.

The sliding of the central rod between the two spreading plates makes it possible to obtain a separation of said plates due to the relative sliding of the bevels of the central rod and these two spreading plates. Initially, the contact area between the bevels of the central rod and those of the spreading plates is maximal, while it becomes smaller during the sliding of the central rod, which causes the separation of the plates. The complementary profile of the bevels of the central rod and those of the separating plates provides the parallel separation of the separating plates, the slopes of the bevels of the central rod and the separating plates canceling one another out once the latter are placed in contact with one another. The parallel spreading obtained in this way has proven particularly effective to perform body straightening work, such as eliminating creases on longerons.

It has also been possible to observe that in order to obtain a good distribution of the forces over the entire length of the spreading plates, the beveled part of the plates must advantageously occupy a significant portion of the surface of said plates, since during spreading, only the beveled parts of the plates remain in contact with the bevels of the central rod, which transmits the spreading force. The maximum slope of the bevel machined on each spreading plate is also limited by the thickness of the spreading plates.

According to one advantageous embodiment, the spreading plates of the spreader according to the invention comprise at least two bevels. With an equal plate thickness, by multiplying the number of bevels, it is possible to increase the slope thereof, since their length is reduced relative to the length of a single bevel. With the increase in the slope of the bevels, it can be observed that in order to obtain a given spreading of the plates, a sliding of the central rod over a smaller length is necessary. It has additionally been possible to observe that a smaller sliding length of the central rod is associated with a better distribution of the forces over the entire surface of the plates during spreading, and consequently increased stability and optimal parallelism of the spreader according to the invention. In particular, it was possible to determine that a number of bevels equal to two offered optimal performance for the spreader according to the invention while allowing easy manufacturing and a reasonable production cost for the spreader according to the invention.

According to one advantageous embodiment, the means for actuating the translation of the central rod comprise a hydraulic jack system. Other actuating means can also be considered, such as a pneumatic jack system or such as a thread on the central rod that is then actuated in translation by rotating a tapped part surrounding said central rod.

BRIEF DESCRIPTION OF THE FIGURES

These aspects, as well as other aspects of the invention, will be clarified in the detailed description of specific embodiments of the invention, reference being made to the drawings of the figures, in which.

The figures are not drawn to scale. Generally, similar elements are denoted by similar references in the figures.

DETAILED DESCRIPTION OF SPECIFIC EMBODIMENTS

Figure 1:
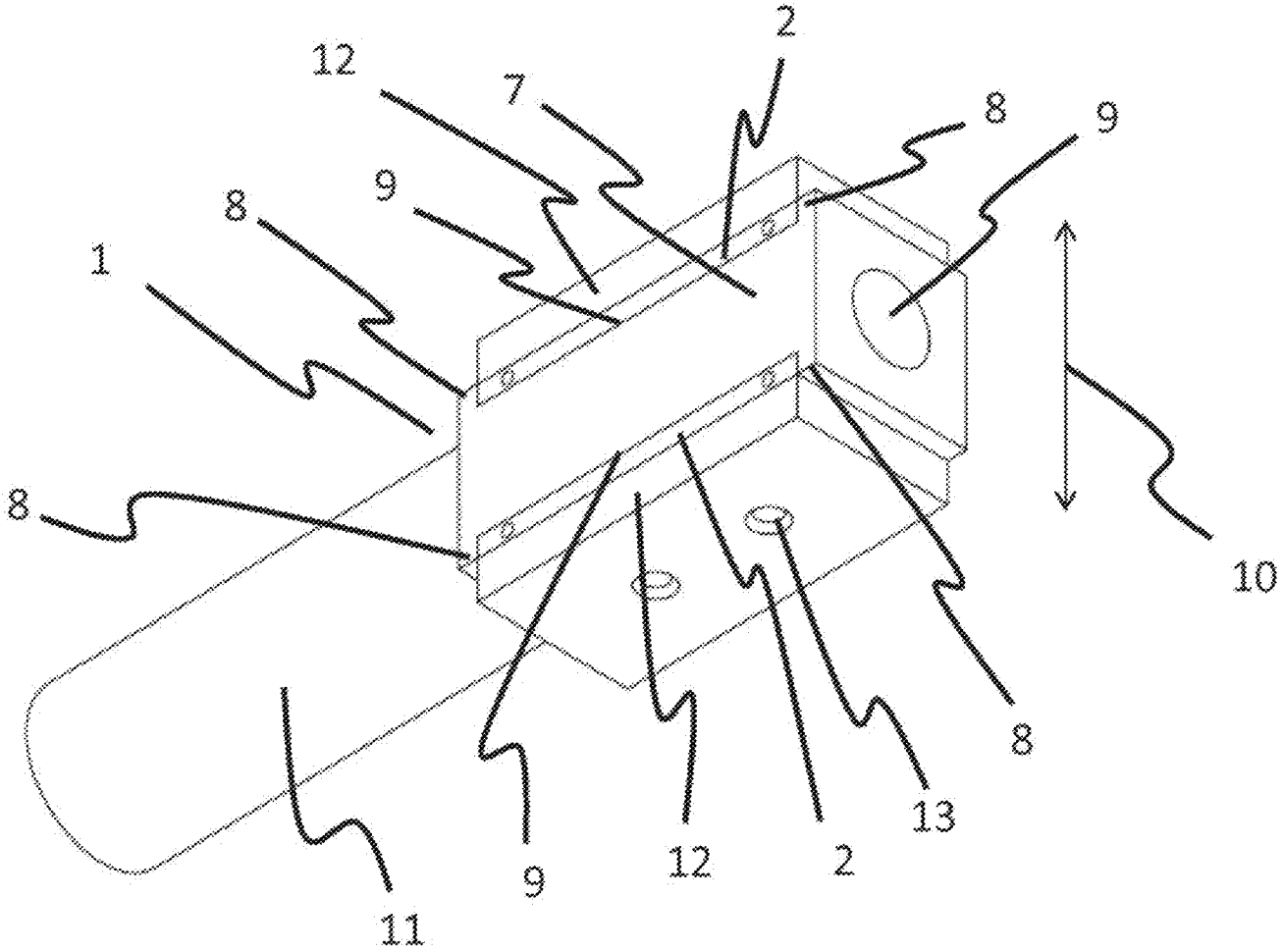
FIG. 1 is a view of the spreader according to the invention.

FIG. 1 therefore shows one embodiment of the spreader according to the invention that can be used for example to straighten the longeron of a vehicle along a spreading axis 10. The spreader comprises a support 1 and two spreading plates 2. The support 1 comprises a hollow head 7 comprising side openings 9, said spreading plates 2 being inserted into said side openings 9. The support 1 also comprises a cylinder 11 in which the central rod and the means for actuating the translation thereof are located. The spreading plates 2 comprise removable layers 12 attached using fastening means 13. In this way, the initial spacing between the spreading plates can be adjusted based on dimensions of the longeron to be straightened. The spreader also comprises a front opening 9 allowing the passage of the central rod. The spreader further comprises protrusions 8 around said side openings 9 that serve as means for immobilizing the spreading plates 2 in planes perpendicular to said spreading axis 10. The spreading plates must in fact only be able to move in the direction of the spreading axis 10 and not be mobile in the other spatial directions.

Figure 2:
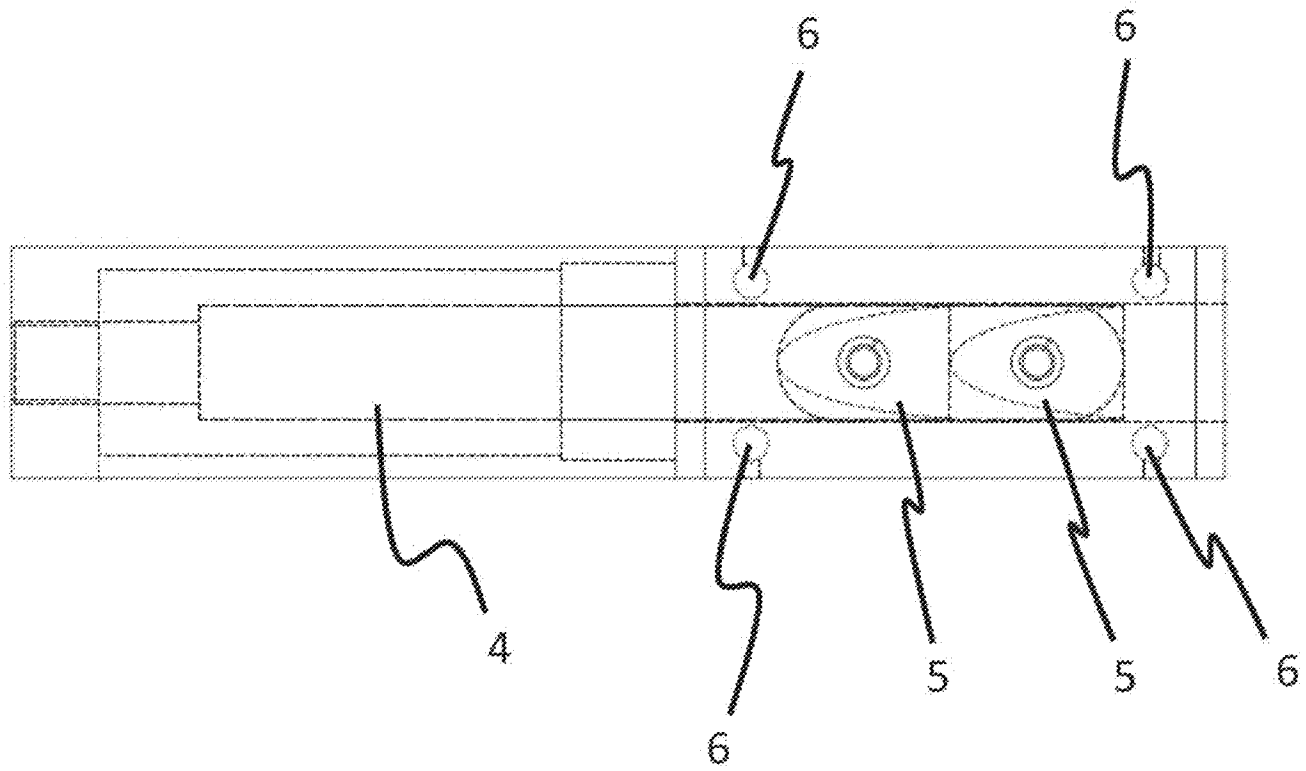
FIG. 2 is a first sectional view of the spreader according to the invention.

FIG. 2 shows a first sectional view of the spreader according to the invention. This view shows the bevels 5 of the central rod 4, as well as the passages 6 machined in the support 1 that are traversed by springs connecting the two spreading plates 2. These springs therefore serve as return means on the spreading plates so that they remain secured to the support.

Figure 3:
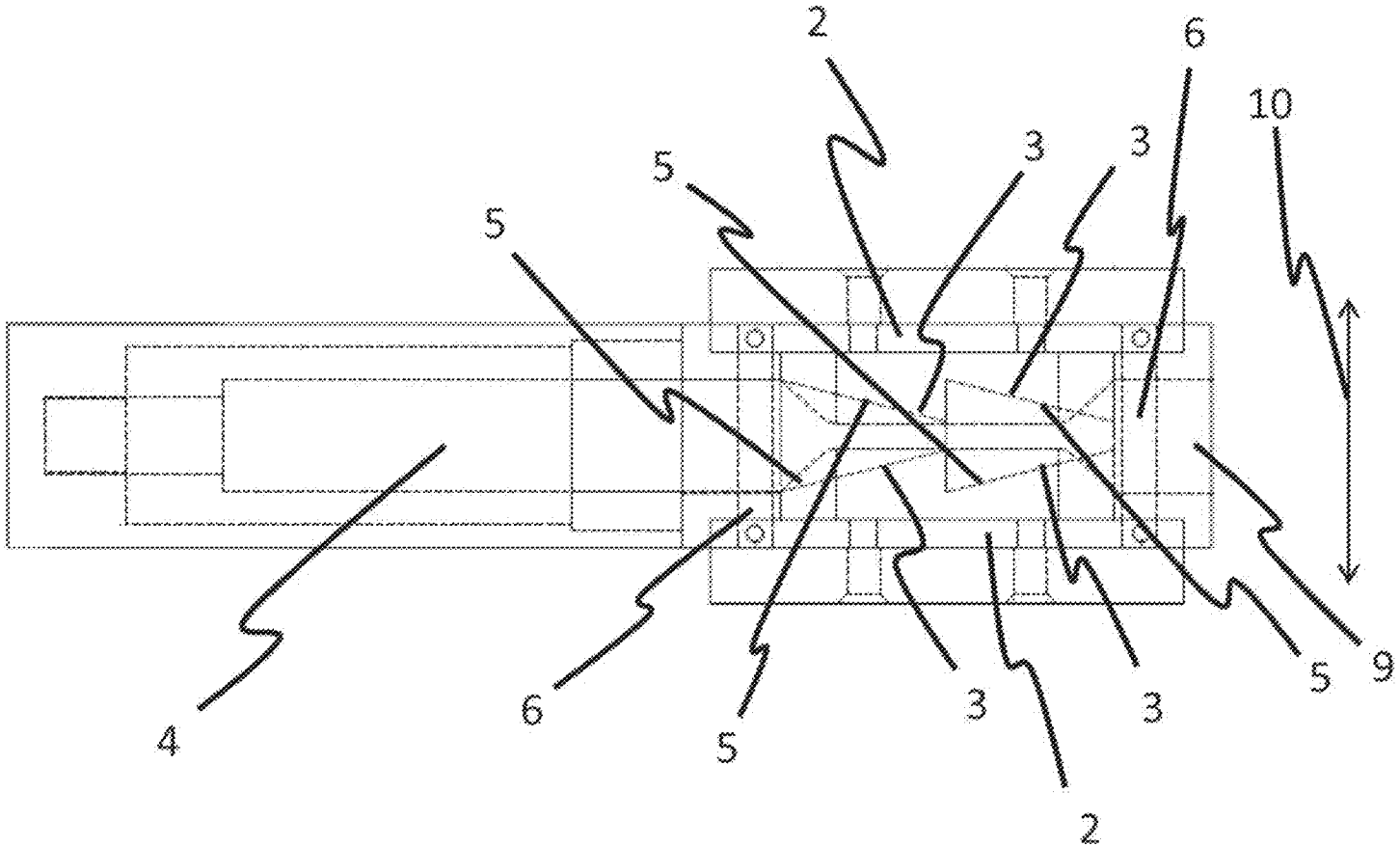
FIG. 3 is a second sectional view of the spreader according to the invention.

FIG. 3 shows another sectional view of the spreader according to the invention. In this view, one can see that the spreader is in the initial position, i.e., before spreading. The bevels 5 of the central rod 4 and the bevels of the spreading plates 2 are in fact completely in contact with one another. The spreading of the plates 2 will occur during the sliding of the central rod 4 toward the front opening 9 in the support 1. As the central rod 4 slides forward, the plates 2 will separate, while the contact area between the bevels 5 of the central rod 4 and the bevels 3 of the separating plates 2 will decrease. In this FIG. 3, the passages 6 are also clearly visible that are intended to receive the springs connecting the spreading plates to one another in order to exert a return force on the latter.

It will appear obvious for one skilled in the art that the present invention is not limited to the examples illustrated and described above. The invention comprises each of the new features and the combinations thereof. The presence of reference numbers cannot be considered limiting. The use of the term "comprise" may not in any manner preclude the presence of elements other than those that are mentioned. The use of the definite article "a" to introduce an element does not preclude the presence of a plurality of these elements. The present invention has been described in connection with specific embodiments, which have a purely illustrative value and must not be considered limiting.

The invention claimed is:

1. A mechanical spreader along a spreading axis (10), characterized in that it comprises a support (1) and two spreading plates (2), each spreading plate (2) comprising at least one bevel (3), and in that it also comprises a central rod (4) able to slide in said support (1) between the two spreading plates (2), said central rod (4) comprising a plurality of bevels (5) having a profile complementary to the bevels (3) of said spreading plates (2), the bevels (5) of said central rod (4) being in contact with the bevels (3) of said spreading plates (2), said spreader also comprising return means able to exert a return force on the spreading plates (2), means for actuating the translation of the central rod (4) and means for immobilizing the spreading plates (2) in planes perpendicular to said spreading axis.

2. The spreader according to claim 1, characterized in that each spreading plate (2) comprises at least two bevels (3).

3. The spreader according to claim 1, characterized in that said return means comprise springs connecting the two spreading plates (2), said springs traversing passages (6) machined in said support (1).

4. The spreader according to claim 1, characterized in that said support comprises a hollow head (7) comprising side openings (9), said spreading plates (2) being inserted into said side openings (9).

5. The spreader according to claim 4, characterized in that said means for immobilizing the spreading plates comprise protrusions (8) around said side openings (9).

6. The spreader according to claim 4, characterized in that the hollow head (7) comprises a front opening (9) allowing the passage of said central rod (4).

7. The spreader according to claim 4, characterized in that the means for actuating the translation of the central rod (4) comprise a hydraulic jack system.

* * * * *